US005736815A

United States Patent [19]

Amemiya

[11] Patent Number: 5,736,815

[45] Date of Patent: Apr. 7, 1998

[54] PLANER DISCHARGE TYPE PLASMA DISPLAY PANEL

[75] Inventor: Kimio Amemiya, Koufu, Japan

[73] Assignee: Pioneer Electronic Corporation, Tokyo, Japan

[21] Appl. No.: 680,041

[22] Filed: Jul. 15, 1996

[30] Foreign Application Priority Data

Jul. 19, 1995 [JP] Japan ..... 7-205165

[51] Int. Cl.[6] ..... H01J 11/02

[52] U.S. Cl. ..... 313/586; 313/584; 313/587

[58] Field of Search ..... 313/582, 584, 313/585, 586, 587

[56] References Cited

U.S. PATENT DOCUMENTS 5,541,479 7/1996 Nagakubo ..... 313/586

FOREIGN PATENT DOCUMENTS 57-103223(A) 6/1982 Japan ..... 313/587

60-47340(A) 3/1985 Japan ..... 313/586

*Primary Examiner*—Nimeshkumar Patel

*Attorney, Agent, or Firm*—Fish & Richardson P.C.

[57] ABSTRACT

A planer discharge type plasma display panel has an internal configuration to suppress an increase in power consumption and also to provide high brightness in the sense of visual sensation. A pair of row electrodes X,Y parallel to each other are formed on a front glass substrate in the display section, and transparent electrodes with a discharging gap formed in a portion thereof and bus electrodes are formed on a portion of the substrate, and a dielectric layer is further formed to cover the electrodes. The dielectric layer is formed so that a film thickness of the bus electrode is made larger as compared to that of the dielectric layer in a light emitting region between the opposing bus electrodes, namely by providing a protruding section thereon. The area of the protruding section is made small in a central portion of the PDP, and is gradually made larger in a direction from the central portion to the peripheral section thereof.

1 Claim, 7 Drawing Sheets

PLANER DISCHARGE TYPE PLASMA DISPLAY PANEL

BACKGROUND OF THE INVENTION

1. Field of the Invention

The present invention relates to a plasma display panel, and more particularly to an internal configuration of a plasma display panel.

2. Description of Background Information

In recent years, plasma display panel (hereinafter, referred to as PDP) has been receiving attention as a third display device following the CRT and liquid crystal display. This is because of its capability of a high quality display resulting from the fact that it is of a self-light emitting type with a wide angle of visibility and high speed of response, as well as it is suited to upsizing because of its simplicity in the manufacturing process.

The color version of the PDP is generally classified into AC and DC types each driven by a different method of driving the panel. Both of the AC and DC type PDPs provide display in color by exciting fluorescent bodies for three primary colors of red, green, and blue, which are formed within the panel, with ultraviolet rays generated by discharging a gas. In the DC type color PDP, an electrode is exposed to a discharge space, while, in the AC type color PDP, an electrode is covered with a protective layer. For this reason, the AC type color PDP has such characteristics that it inherently has a long life and the brightness is not lowered because of a particular function of memory even if the number of display lines are increased to realize a large size screen.

FIG. 1 is an exploded perspective view showing the configuration of a AC type PDP 15. Two electrodes for display X and Y opposite to each other are formed on a front glass substrate 1 of a display surface, and an A/C voltage is loaded between these parallel electrodes so that planer discharge is achieved therebetween. Each of the electrodes X, Y, comprises transparent electrodes 2*a*, 2*b* and bus electrodes 3, respectively. The bus electrode 3 is formed on a portion of the transparent electrodes 2*a*,2*b* to prevent a voltage drop due to the resistance of the transparent electrodes 2*a*, 2*b*. A dielectric layer 4 is formed on the transparent electrodes 2*a*, 2*b* and a protective film 5 made of magnesium oxide (MgO) is formed thereon by evaporation.

Address electrodes 7 are formed on a rear side glass substrate 6 in a direction perpendicular to the transparent electrodes 2*a*, 2*b*. Stripe-shaped partition walls 8 are formed between the address electrodes 7 to separate them and to prevent coupling with adjacent cells. Fluorescent bodies 9 of three colors (RGB) are discretely painted and printed on the side surfaces of the partition wall 8 and on the address electrodes 7 respectively.

A gap 10 formed between these two sheets of glass substrates 1, 6 is filled with a mixed gas of xenon (Xe) for irradiating ultraviolet rays to have the fluorescent body 9 excited and make it emit light and neon (Ne) for main discharge.

A driving circuit for driving this AC type PDP 15 comprises, as shown in FIG. 2, a signal processing section 20 for processing a composite video signal as an input signal and a driving circuit section 30. In the signal processing section 20, an A/D converter 21 converts the input composite video signal, for instance, to data for 8 bits of pixel. On the other hand, a timing pulse generating circuit 23 generates various types of timing pulse according to horizontal and vertical synchronizing signals extracted from the input composite video signals with a synchronizing separator circuit 22. The A/D converter 21 operates in synchronism with these timing pulses for operation. A memory control circuit 24 supplies write and read pulses, each synchronized with a timing pulse from the timing pulse generating circuit 23, to a frame memory 25, successively reads out pixel data from the A/D converter 21 memory 25 fetching the data into the frame memory 25, and supplies the data to an output processing circuit 26 in the next step. The output processing circuit 26 has this pixel data synchronized to a timing pulse from the timing pulse generating circuit 23, and supplies the pixel data to the pixel data pulse generating circuit 31.

A PDP 15 comprises columns of electrodes (address electrodes 7) indicated with D1, D2, D3, . . . Dm and rows electrodes (XY electrodes 2*a*, 2*b*) indicated with x1, x2, x3, . . . xn and y1, y2, y3, . . . yn in which x and y form a pair and constitute a line. A scanning/maintanence/erasing pulse generating circuit 32 applies a scanning pulse, having a potential for having discharge started in response to a timing pulse from the timing pulse generating circuit 23, to an X electrode in the PDP 15. Also the scanning/maintenance/erasing pulse generating circuit 32 generates a maintenance pulse having a potential for maintaining a discharging state in response to a timing pulse from the timing pulse generating circuit 23, and applies the maintenance pulse to a Y electrode and to an X electrode in the PDP 15, respectively. In this step, the maintenance pulses are applied to the XY electrodes with timings shifted to each other. Furthermore, the scanning/maintenance/erasing pulse generating circuit 32 applies a discharge erasing pulse, for stopping the discharging state in response to the timing pulse from the timing pulse generating circuit 23, to an X electrode in the PDP 15.

The pixel data pulse generating circuit 31 generates a pulse for pixel data in response to each pixel data supplied from the output processing circuit 26, and applies the pulses to the column electrodes (address electrodes 7). As described above, the PDP 15 has a structure in which a digitized video signal is driven in the driving circuit dedicated to the PDP 15 according to complex timings specified by the pixel data pulse generating circuit 31 or scanning/maintenance/erasing pulse generating circuit 32, so that a pixel emits light with a matrix consisting of a row electrode and a column electrode.

In recent years, with respect to projection TVs or luminescent type LCDs or the like, users' interest to watch images on a light display screen, has been becoming increasingly intense, and also assisted by active development and technological innovations in the fields of components and circuits, a substantially higher level of brightness is now required as compared to the previous level. Under the market's demands as described above, it is inevitable to provide a high brightness together with sharp color images also in a color PDP.

However, as described above, the PDP digitally drives composite video signal having been converted to a digital signal according to a timing pulse. For this reason, to enhance the brightness of the PDP, such a method as raising a pulse voltage, namely a driving voltage, is conceivable. However, when the driving voltage is made higher, the power consumption also increases. When the frequency of a pulse is increased, the discharge power into a floating capacity between the PDP electrodes increases, and as a result, the power consumption increases like in a case where the driving voltage is increased, therefore a PDP with low power consumption, yet enabling high brightness, has not been realized.

OBJECT AND SUMMARY OF THE INVENTION

The present invention has been made by focusing attention on the problems described above, and it is an object of the present invention to provide a planer discharge type plasma display panel having internal configuration in which a desired level of brightness can be obtained without having the power consumption increased.

The present invention has been made for solving the problems as described above, and provides a planer discharge type plasma display panel comprising a first substrate and a second pair, forming a substrate of substrates opposite to each other with a discharging gap formed therebetween. A plurality of row electrode pairs is provided on an internal surface of the first substrate, each electrode in the electrode pair being separated from each other by the discharging gap, and each extending in the horizontal direction. A dielectric layer covers the internal surface of the first substrate and the pair of row electrode and a plurality of column electrodes provided on an internal surface of the second substrate extends in a vertical direction. A plurality of partition walls each provided on the internal surface of the second substrate between column electrodes, each for partitioning the discharge gap to unit light emitting region. And the planer discharge type plasma display panel is characterized in that the surface of the dielectric layer in an edge section opposite to the discharge gap projects relative to the surface of the dielectric layer in an edge section close to the discharge gap, and at the same time the area of the protruding section of the dielectric layer in a unit of light emitting region in the peripheral section of the panel is made larger as compared to that of the protruding section of the dielectric layer in a unit light emitting region in the central portion of the panel.

With the planer discharge plasma display panel according to the present invention, the surface of the dielectric layer in an edge section opposite to the discharge gap is protruding, and the surface of the protruding area of the dielectric layer in the peripheral area of the panel is made larger as compared to that in the central portion thereof, so that expansion of discharge in the unit light emitting region in the central section of the panel can be restricted, and expansion of discharge can further be suppressed in the peripheral section of the panel, and for this reason a discharge current can be restricted. As a result, the power consumption can be reduced.

DETAILED DESCRIPTION OF THE PREFERRED EMBODIMENT

Figure 1:
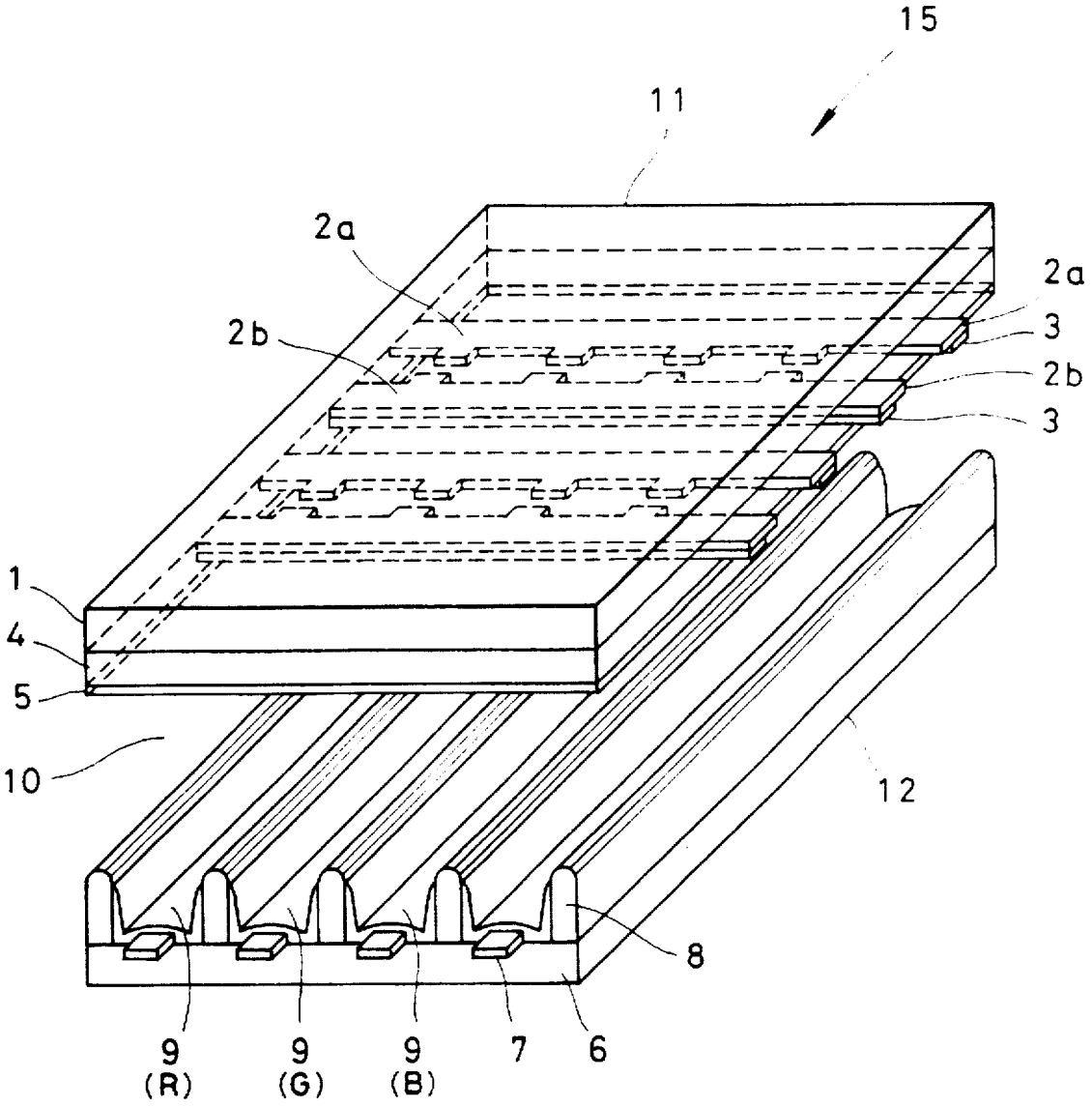
FIG. 1 is a perspective view showing configuration of a PDP based on the conventional technology.
Figure 2:
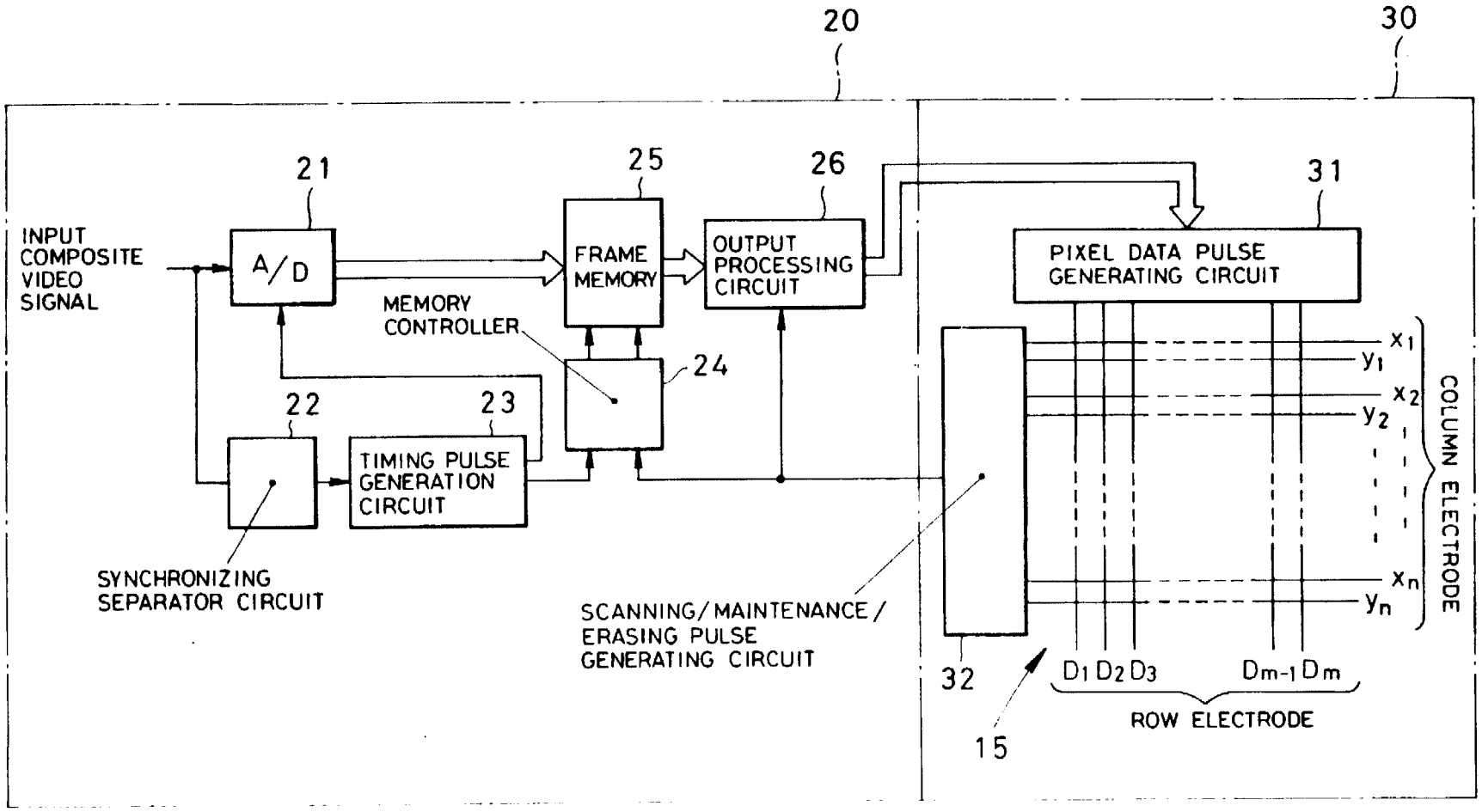
FIG. 2 is a block diagram of a driving section of the PDP shown in FIG. 1.
Figure 3:
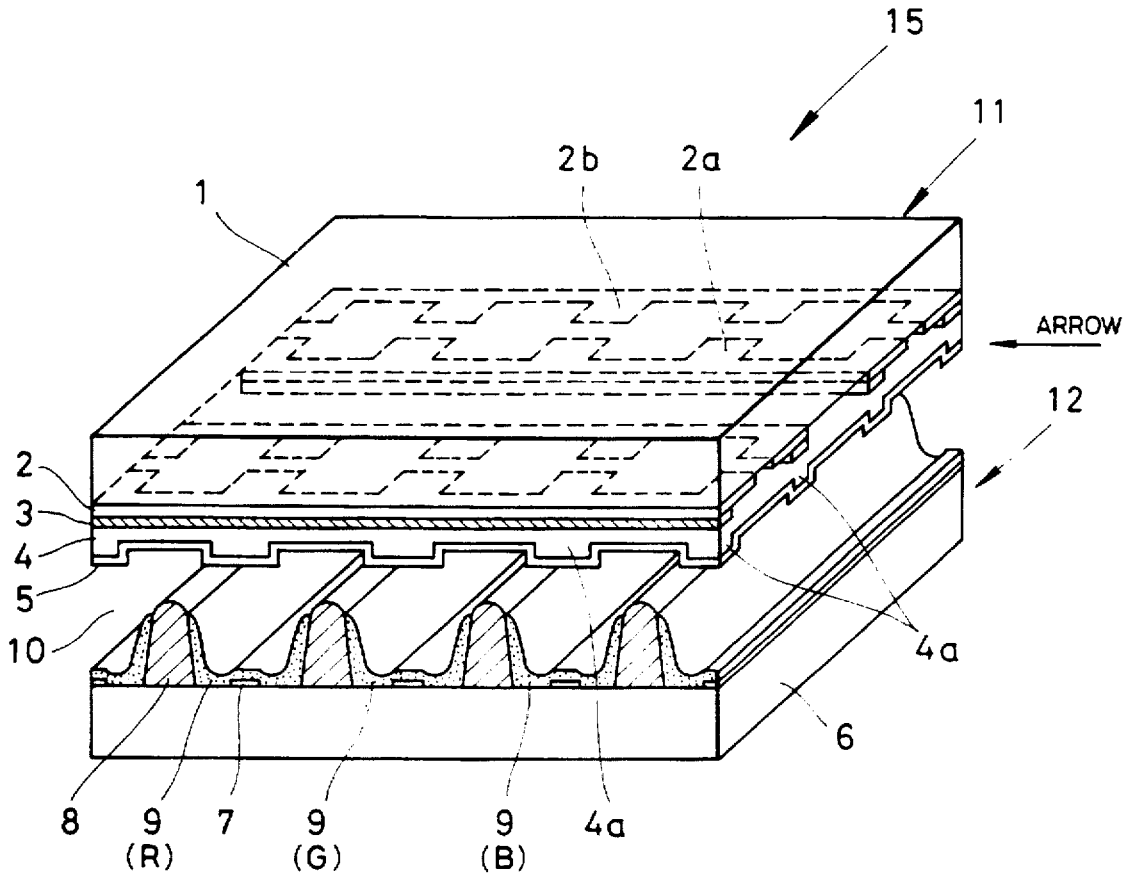
FIG. 3 is a perspective view showing an embodiment of a PDP according to the present invention.
Figure 5:
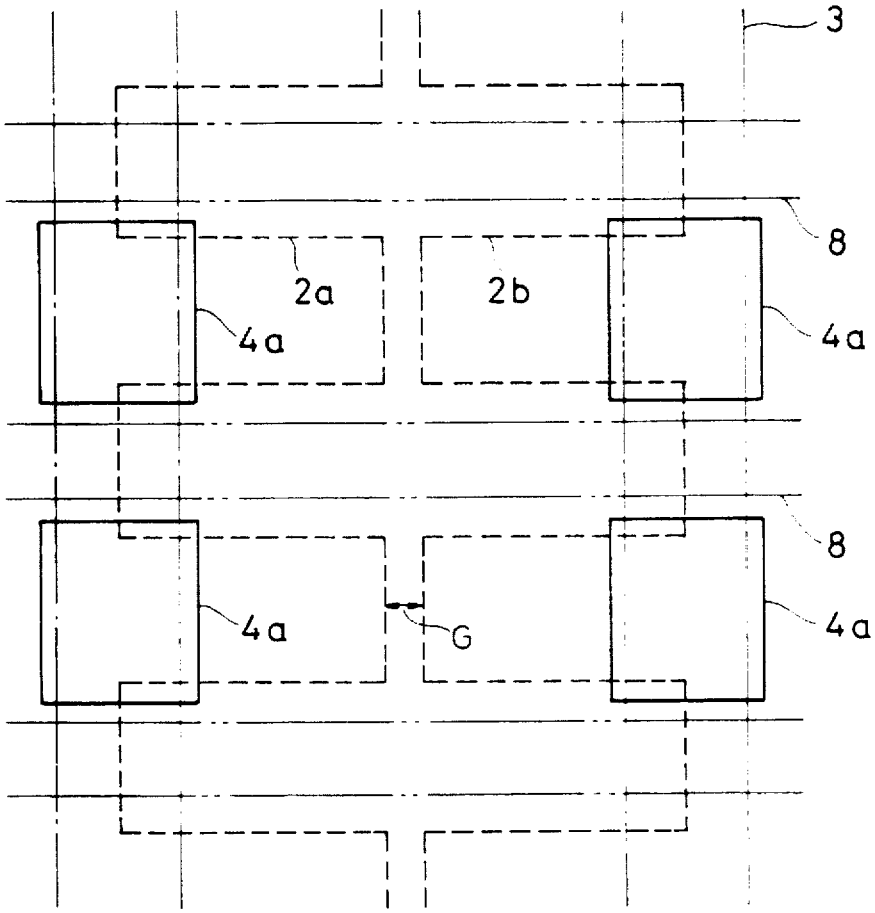
FIG. 5 is a perspective drawing of the PDP according to the embodiment of the present invention viewed from a side of the surface thereof.
Figure 6:
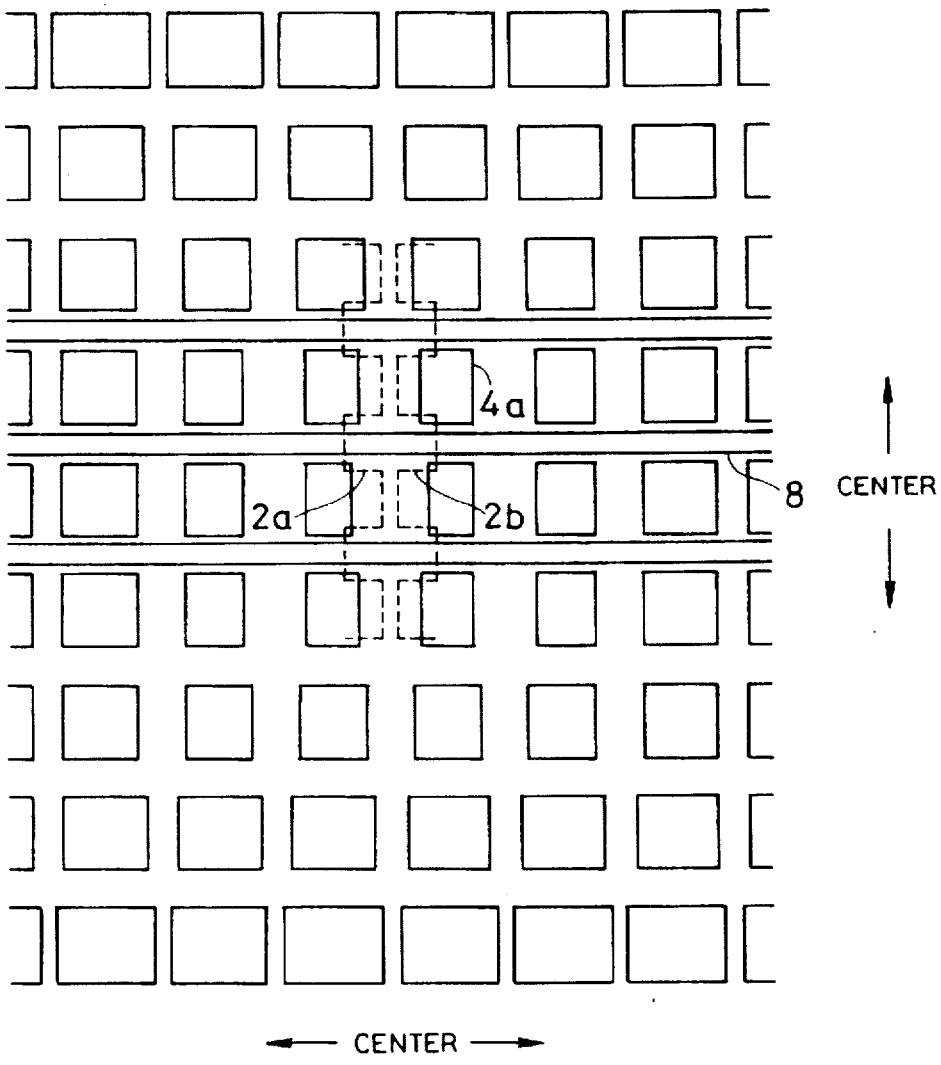
FIG. 6 is a view showing the distribution around a protruding section of the PDP according to the embodiment of the present invention.
Figure 7:
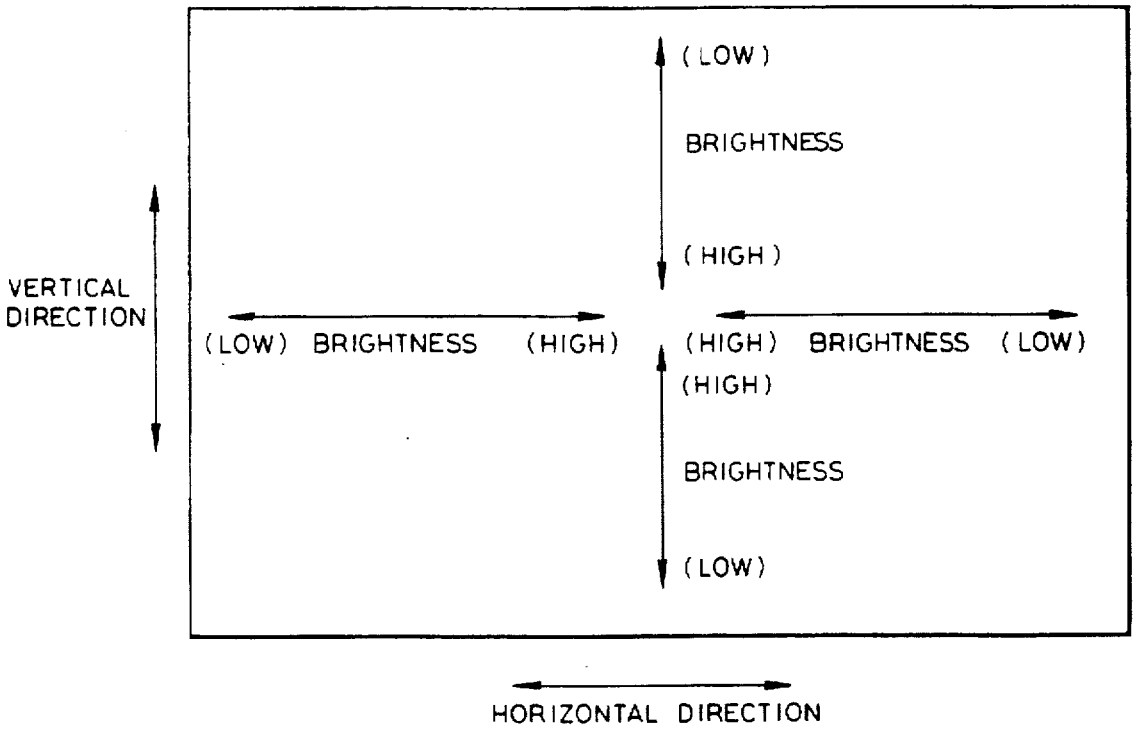
FIG. 7 is a view showing a state of screen display in the PDP according to the embodiment of the present invention.

FIG. 3 is an exploded perspective view showing a PDP 15 according to an embodiment of the present invention; and to describe the PDP 15 more. Description for the PDP 15 is made with reference to FIG. 4 which is an enlarged sectional view of the PDP 15 viewed from the direction indicated by the arrow in the FIG. 3. FIGS. 5 and 6 are perspective views from the side of display surface thereof. It should be noted that the same reference numerals are assigned to the same portions as those in FIGS. 1 and 2 based on the conventional technology.

Figure 4:
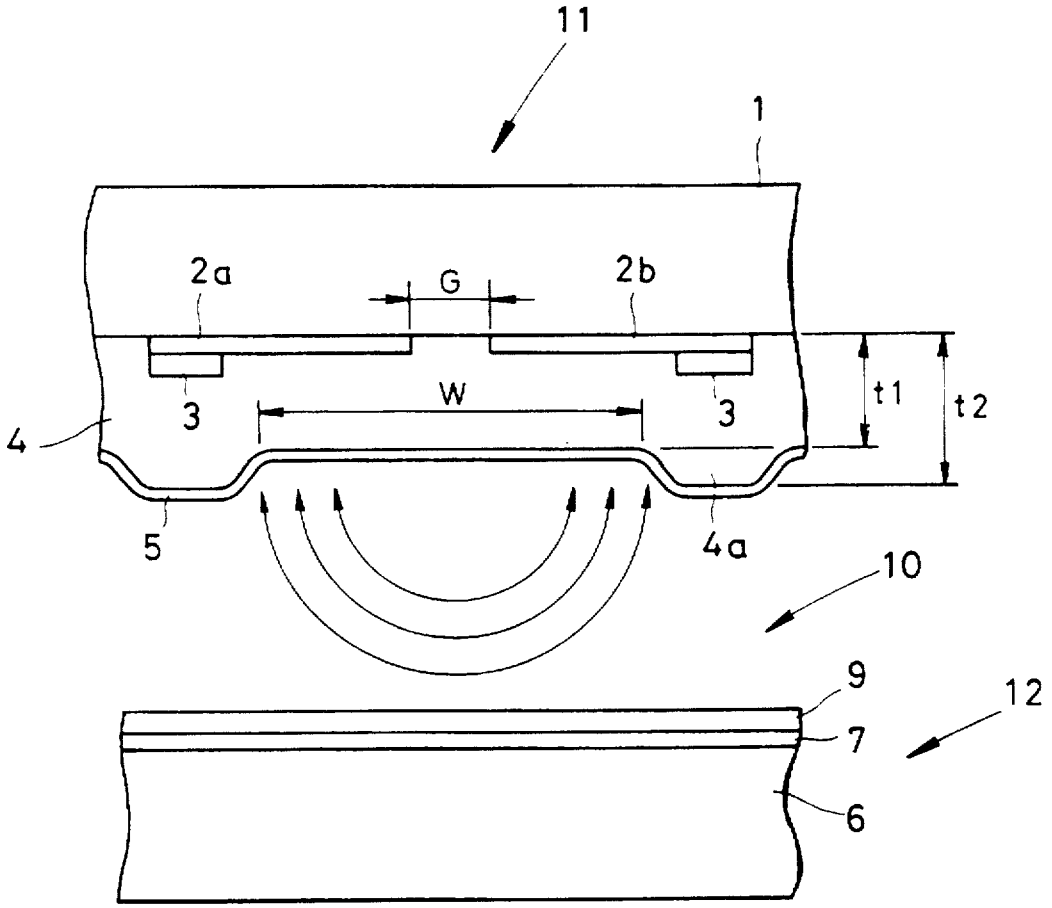
FIG. 4 is an enlarged sectional view showing the PDP according to the embodiment of the present invention.

In FIG. 4, transparent electrodes 2*a* and 2*b* as a pair of row electrodes X and Y opposite to each other are formed on the front glass substrate 1 as the first substrate of a display section 11, and a portion of each of the transparent electrodes 2*a*, 2*b* are protruding with a convex form and a discharging gap G is formed therebetween so that discharge can easily be carried out. Bus electrodes 3 are formed on the transparent electrodes 2*a*, 2*b*. Also, a dielectric layer 4 is formed so that it covers the transparent electrodes 2*a*,2*b* and bus electrodes 3. In this dielectric layer 4, there is provided a protruding section 4*a* with the film thickness on the bus electrode 3 larger than that of the dielectric layer 4 in a light emitting region (an area enclosed by partition walls opposite to the opposing bus electrodes 3, respectively) between the opposing bus electrodes 3. The area of the protruding section 4*a* is small, as shown in FIG. 6, at the central portion of the PDP 15, and is made gradually larger in the direction from the central portion to the peripheral section. The entire surface of the dielectric layer 4 including these protruding sections 4*a* is laminated with magnesium oxide (MgO) to form a protective film 5.

As shown in FIG. 3, partition walls 8 are arranged in parallel to each other on a rear glass substrate 6 as a second substrate of the rear section 12, and extend in a direction perpendicular to the transparent electrodes 2*a* and 2*b* in their longitudinal direction. The partition walls 8 are formed with transparent or white highly reflective glass paste, or glass paste containing black pigment made of iron oxide, cobalt oxide, chromium oxide or the like to enhance contrast. Furthermore, address electrodes 7 made of, for instance, aluminum (Al) or an aluminum alloy, namely column electrodes are formed on the rear glass substrate 6 in parallel to each other in a plurality of lines so that the column electrodes extend over the entire surface of the rear glass substrate 6 between the adjoining partition walls 8. Three units of address electrodes corresponding to R, G, B signals, respectively, are grouped to form a set to realize a color PDP.

It should be noted that material for the address electrodes 7 are not necessarily limited to aluminum (Al) or an Al alloy, but such metals as copper (Cu), gold (Au) or an alloy thereof, each having a high-reflective property may be used for this purpose. Fluorescent layers 9 (R), 9(G), 9(B) each comprising a fluorescent body corresponding to each of R, G, B are formed on the three address electrodes 7, respectively, so that each of the three address electrodes 7 and each side of the partition walls 8 are covered with the corresponding layers.

A gas space 10 formed between the display section 11 and the rear surface section 12 is partitioned with the partition walls 8 into a plurality of light emitting regions between the MgO layer 5 on the front glass substrate 1 and the fluorescent bodies 11R, 11G, and 11B each formed on the rear grass substrate 6. This gas space 10 is filled with a rare gas such as Ne-Xe gas or He-Xe gas.

Next, description is made for operations in the embodiment of the present invention with reference to FIGS. 4 and 5, and as the present inventor disclosed a planer discharge type plasma display panel using a protruding section in Japanese Patent Application No. 7-55618.

As shown in FIGS. 4 and 5, the protruding section 4a comprising a dielectric 4 layer is formed on the surface of the bus electrode 3 at a position excluding an upper section of the partition wall 8 perpendicular thereto, so that the gas space 10 provided between the front glass substrate 1 and the rear glass substrate 6 is narrow at a portion below the protruding section 4a and wide in a flat section other than the protruding section 4a. For this reason, a voltage for starting discharge on the bus electrode 3 is higher than that on the flat section, namely on the light emitting region. Electric discharge is started at a discharging gap W, and expends into a planer discharge over the transparent electrode, but the discharge is stopped or becomes weak on the bus electrode, and accordingly a discharge current in the bus electrode is reduced or restricted. For this reason, the area of a light emitting region on the front glass substrate 1 is substantially restricted to an area surrounded by the protruding sections 4a opposite to the partition wall 7. Namely, by widely extending one edge of the protruding section 4a to the side of discharging gap G in the transparent electrodes 2a, 2b a light emitting region can be made narrower. Namely it is possible to change the area of a light emitting region according to a dimension W between the protruding sections 4a opposite to each other which is typically shown in FIG. 4.

FIG. 6 partially shows a relationship among the transparent electrodes 2a, 2b protruding section 4a, and the partition wall 8 in the PDP 15. The protruding section 4a is made smaller in the central portion of the screen and is made wider increasingly in a direction from the central portion to the peripheral section of the screen. As a result, when the PDP 15 is caused to emit light, the brightness in the central portion of the screen is higher as compared with that in the peripheral section. Herein, image data in the central portion of the screen is more important, when visually recognized, than that in the peripheral section thereof, and for this reason, even when the brightness in the periphery is made low, it is possible to obtain a visual feeling of high brightness therein because the brightness in the central portion of the screen is higher.

In a case where a dielectric layer 4 is formed in the PDP manufacturing process, a glass paste is applied to the transparent electrodes 2a, 2b as well as, to the bus electrodes 3 to cover them. The dielectric layer 4 is then formed by means of sintering, but it is necessary to use a mask for the glass paste and add an applying/sintering process to the protruding section 4a.

For thickness of the dielectric layer 4, a film thickness t1 of the flat section on the light emitting region in a range from 20 to 30 μm, and the film thickness t2 of the protruding sections 4a is in a range from 27 to 130 μm, and preferably in a range from 10 to 20 μm. A ratio between the film thickness t1 of the flat section on the light emitting region and the film thickness t2 of the protruding section 4a (t1:t2) may be 1:1.25 to 5.0, and preferably 1:1.3 to 2.0.

It should be noted that planer discharge in the PDP 15 is started at a portion of the discharge gap G and then gradually expands along the edges of the transparent electrodes 2a, 2b to the bus electrodes 3. However, if any gap is formed under the partition wall 8 due to non-uniformity in the thickness (several μm) of the bus electrode 3, or due to any pits and projections on a surface of the partition wall 8, as the transparent electrode exists even in a gap under the partition wall, and for this reason, luminescence due to discharge may be generated through this gap in the adjoining discharge space.

However, the protruding section 4a in the dielectric layer 4 on the bus electrode 3 is further protruding as compared to other sections, and for this reason a partition wall 8 and a portion of the dielectric layer 4 are closely contacted to each other so that a gap between them substantially disappears, which prevents the planer discharge from being expanded to the adjacent cells. Also planer discharge can be prevented from expanding up to the adjacent cell close to the protruding section 4a of the dielectric layer 4. In the embodiment described above, the dielectric layer 4 has protruding sections 4a only on the bus electrodes 3 in a light emitting region in which the dielectric layer 4 is opposite to the partition wall 8, but also a planer discharge type PDP 15 having a protruding section 4a extending up to an adjacent cell in a column direction on and along the bus is allowable.

In the embodiment of the present invention, as shown in FIG. 6, each of protruding sections 4a is formed like a separate island, but also a continuous and band-shaped protruding section 4a with the thickness gradually changed in the direction from a central portion to a peripheral portion of a screen formed on bus electrodes crossing the partition walls at right angles respectively is also allowable.

Furthermore, in the embodiment described above, an area of the protruding section of the dielectric layer on the bus electrode is gradually made larger in the direction from the central portion to the peripheral portion of the panel, but it is needless to say that the area may be larger step by step. Also in each of light emitting regions, a transparent electrode 2a, 2b, has protruding sections opposite to each other, but it may be formed with a band-shaped one without any protruding section 4a formed thereon.

As described above, with the planer discharge plasma display panel according to the present invention, a surface of a dielectric layer 4 in an edge section opposite to a discharge gap is protruding and an area of the protruding section 4a of the dielectric layer a is made larger in the peripheral section of the panel as compared with that in the central portion thereof, so that extension of discharge in a unit light emitting region in the central section of the panel can be restricted, and extension of discharge can further be suppressed in the peripheral portion thereof, which enables the suppression of a discharge current. As a result, the power consumption can also be reduced.

What is claimed is:

1. A planer discharge type plasma display panel comprising:

a pair of substrates comprising first and second substrates each opposing a discharge space and separated thereby;

a plurality of pairs of row electrodes each provided on an internal surface of said first substrate, each row electrodes of said pairs being separated from each other by a discharge gap and extending in the horizontal direction;

a dielectric layer for covering the internal surface of said first substrate and said pairs of row electrodes;

a plurality of column electrodes each provided on an internal surface of said second substrate and extending in the vertical direction; and a plurality of partition walls each provided on the internal surface of the second substrate between said column electrodes and partitioning said discharge space into a plurality of unit light emitting regions;

wherein a thickness of said dielectric layer from said discharging gap is larger than a thickness of said dielectric layer at a position proximate said discharging gap, to form a protruding section, and an area of the protruding section on said dielectric layer in said unit of light emitting region in the peripheral section of the panel is larger than that of the projection section on said derivative layer in said unit light emitting region in the central portion thereof.

* * * * *

UNITED STATES PATENT AND TRADEMARK OFFICE

CERTIFICATE OF CORRECTION

PATENT NO. : 5,736,815

DATED : April 7, 1998

INVENTOR(S) : Kimio AMEMIYA

It is certified that an error appear in the above-identified patent and that said Letters Patent is hereby corrected as shown below:

Claim 1, line 19, insert --at a position distant-- after "layer".

Signed and Sealed this

Twentieth Day of October, 1998

*Attest:*

Bruce Lehman

BRUCE LEHMAN

*Attesting Officer*

*Commissioner of Patents and Trademarks*